United States Patent [19]

Combette et al.

[11] 4,374,567

[45] Feb. 22, 1983

[54] POWDER ACTUATED PISTON TOOL WITH POWER ADJUSTMENT

[75] Inventors: Marc Combette; Jean Ollivier, both of Valence, France

[73] Assignee: Olin Corporation, New Haven, Conn.

[21] Appl. No.: 138,789

[22] Filed: Apr. 9, 1980

[30] Foreign Application Priority Data

Apr. 10, 1979 [GB] United Kingdom ..... 7912653

[51] Int. Cl.[3] ..... B25C 1/14; B25C 1/18

[52] U.S. Cl. ..... 227/10; 227/9

[58] Field of Search ..... 227/8, 9, 10, 11

[56] References Cited

U.S. PATENT DOCUMENTS

| | | | |
|---|---|---|---|
| 3,204,400 | 9/1965 | Kvale | 227/9 X |
| 3,746,235 | 7/1973 | Crabtree, Jr. | 227/9 X |
| 3,918,619 | 11/1975 | Termet | 227/10 X |
| 3,973,708 | 8/1976 | Scotoni | 227/10 |
| 4,068,790 | 1/1978 | Osterle et al. | 227/10 X |
| 4,113,163 | 9/1978 | Combette et al. | 227/10 |

*Primary Examiner*—Paul A. Bell

*Attorney, Agent, or Firm*—Paul J. Lerner

[57] ABSTRACT

A power adjustment for a piston-type powder actuated fastener driving tool wherein a tube is slidably disposed in the barrel of the tool, the tube containing the driving piston of the tool. The tube has a radially inwardly extending flange at its breech end which engages a radially outwardly extending surface on the piston. Means for moving the tube axially of the barrel are provided so that the distance between the flange and firing chamber can be varied whereby the gas expansion chamber between the firing chamber and the rear face of the piston can be varied thereby varying the power with which the piston is driven.

4 Claims, 3 Drawing Figures

POWDER ACTUATED PISTON TOOL WITH POWER ADJUSTMENT

This invention relates to a piston-type powder actuated fastener driving tool, and more particularly to a power adjustment mechanism for such a tool.

It is well known in the piston-type fastener driving tool art that the power output of the tool can be varied by varying the distance between the firing chamber of the tool and the sealing surface of the piston. Varying this distance causes a changing of the volume in the tool into which combustion gases expand when a cartridge is fired in the tool. The larger the volume, the more energy is dissipated by expanding gases before the piston is driven and, therefore, the lower the velocity of the piston. Provision has been made in the past for accurately varying this volume by varying the distance the piston is returned from its fired position to its firing position. In the prior art, piston return variation has been produced by varying the location of the member, such as a pawl, or the like, which engages the piston to return it from its fired position to its firing position. To this end, the piston return member has been made axially movable on the tool, or has been rotatably mounted on the tool so as to present a plurality of different piston engaging faces to engage the piston, each of such faces being axially offset from the others.

This invention relates to a mechanism for adjusting the power to a piston tool wherein the piston is disposed in a tube which is reciprocally slidably mounted in the barrel portion of the tool. The tube includes a radially inwardly extending flange formed at its breechward end, which flange engages a complimentary radially outwardly extending surface on the piston when the piston is in its firing position. Adjustment means, preferably threaded onto the barrel portion of the tool, are provided for axially adjusting the position of the tube within the tool barrel. Manipulation of the adjustment means causes the tube, and therefore, the tube flange, to move within the barrel toward or away from the firing chamber. Since the flange stops breechward movement of the returning piston, the distance between the firing chamber and the sealing surface of the piston will be governed by the position of the tube flange within the barrel. Accurate power adjustment is thus procured since a positive stop within the barrel governs piston position at all times, and the momentum of the returning piston cannot cause a higher than anticipated power level for the tool.

It is, therefore, an object of this invention to provide a power adjustment mechanism for a piston-type powder actuated fastener driving tool wherein a movable stop member is provided within the tool barrel for contacting a breech facing surface on the piston to stop return movement of the piston and determine its firing position.

It is a further object of this invention to provide a power adjustment mechanism of the character described wherein the movable stop is formed as a breechward flange on a tube which houses the piston and is axially slidably movable within the barrel.

It is yet another object of this invention to provide a power adjustment of the character described wherein threaded adjustment means is connected to the barrel for imparting reciprocal axial sliding movement to the tube.

There and other objects and advantages of the invention will become more readily apparent from the following disclosure of a preferred embodiment of the invention taken in conjunction with the accompanying drawings, in which.

Figure 1:
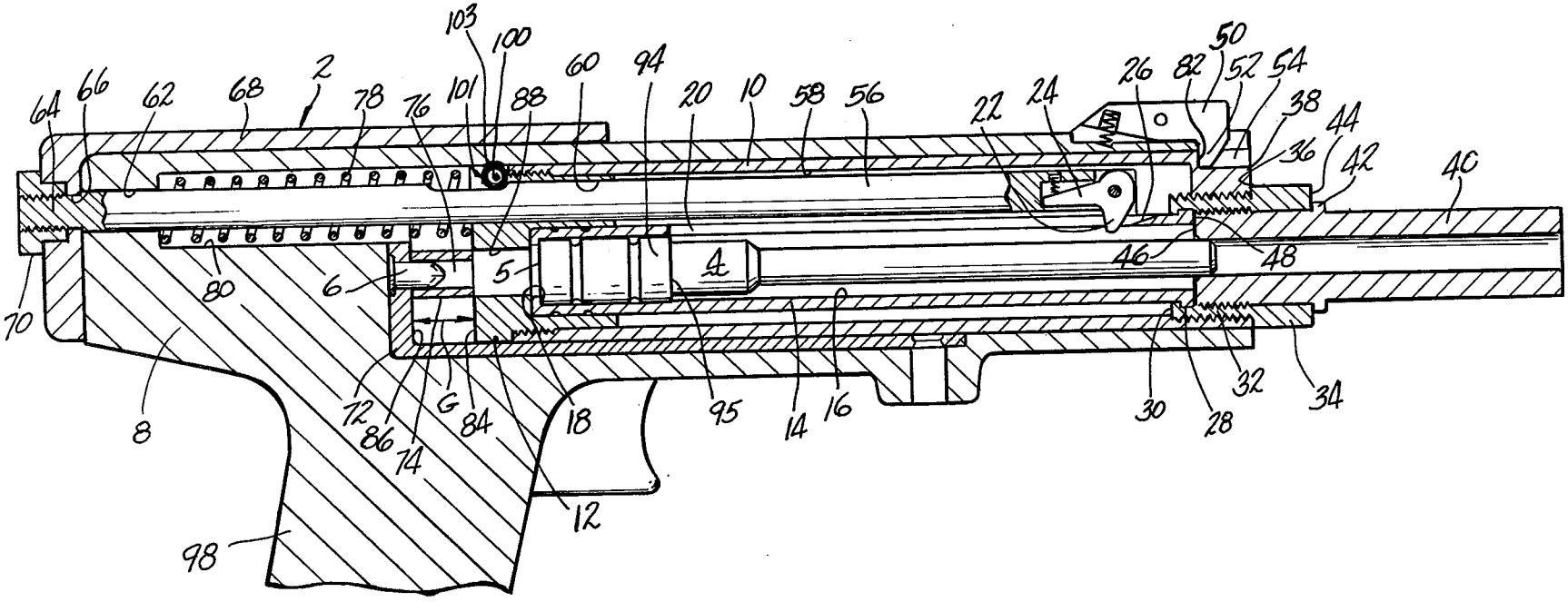
FIG. 1 is an axial sectional view of the major portion of a piston tool incorporating a preferred embodiment of a power adjustment mechanism formed in accordance with this invention, the power level being in its highest mode.

Referring now to the drawings, there is shown in FIG. 1 a tool 2 of the type which utilizes a piston 4 driven by combustion gases from a cartridge 6 to set a fastener in a supporting material.

The tool includes a housing 8 in which is positioned a first barrel 10 which is threaded onto a breech ring 12. Disposed within the first barrel 10 is an inner tube 14, in the bore 16 of which the piston 4 is slidably mounted. The inner tube 14 is telescoped into a counter bore 18 in the breech ring 12. The inner tube 14 is formed with a longitudinally extending slot 20 through which a tang 22 on a pivotally mounted piston-return pawl 24 extends. The muzzle end of the slot 20 is beveled to form a cam ramp 26 which cams the tang 22 out of the slot during push down of the tool.

The inner tube 14 has at its muzzle end a radially outwardly extending flange 28 which is engaged by a radially inwardly extending flange 30 formed on a power adjustment collar 32. The collar 32 is threaded into the muzzle end of the first barrel 10 and includes an enlarged portion 34 forming a shoulder 36 which engages the muzzle end surface 38 of the first barrel 10 when the collar 32 is screwed into the barrel 10 to its fullest extent. A muzzle bushing 40 is threaded into the collar 32 with a flange 42 on the muzzle bushing 40 being screwed tightly against the muzzle end 44 of the collar 32. The inner end 46 of the muzzle bushing 40 is disposed closely adjacent to the muzzle end 48 of the inner tube 14. A spring-biased pivoting pawl 50 is mounted on the muzzle end of the housing 8 and includes a tooth 52 which extends into a keying slot 54 formed at the muzzle end of the first barrel 10.

The piston-return pawl 24 is spring-biased and is pivotally mounted on the muzzle end of a rod 56 which extends through a passage 58 in the first barrel 10, a passage 60 in the breech ring 12, through a passage 62 in the housing 8, and which rod 56 includes a threaded end 64 which extends through a passage 66 formed in a manipulation cover 68 which overlies the rearward end of the housing 8. A nut 70 is threaded onto the threaded end 64 of the rod 56 to secure the rod 56 in place. As will be hereinafter fully explained, the tool 2 may be readily disassembled, as for cleaning, by manipulation of the pawl 50 and removal of the nut 70.

A firing chamber sleeve 72 is mounted in the housing 8 and includes a forwardly extending boss 74 in which the firing chamber 76 is formed.

It will be noted that the outer barrel 10, the breech ring 12, the inner tube 14, the adjustment collar 32, and the muzzle bushing 40 form a sub-assembly which is axially slidable over a limited distance within the housing 8. In FIG. 1 this sub-assembly is shown in its forwardmost position to which it is biased by a spring 78 which surrounds a portion of the rod 56 and which is contained in a counter bore 80 in the housing 8. The forwardmost extent of this forwardmost position is limited by reason of the pawl tooth 52 engaging a rear wall 82 of the slot 54. It will be noted that when this sub-assembly is in its forwardmost position, there is a gap G between the rear wall 84 of the breech ring 12 and the forward wall 86 of the firing chamber sleeve 72. It is further noted that the breech ring 12 is provided with a bore 88 which opens into the rear end of the inner tube bore 16 and the rear face 5 of the piston 4. The bore 88 is sized so that the firing chamber boss 74 will be able to telescope into the bore 88 during push down, when the tool is ready for firing, as shown in FIG. 2.

Figure 2:
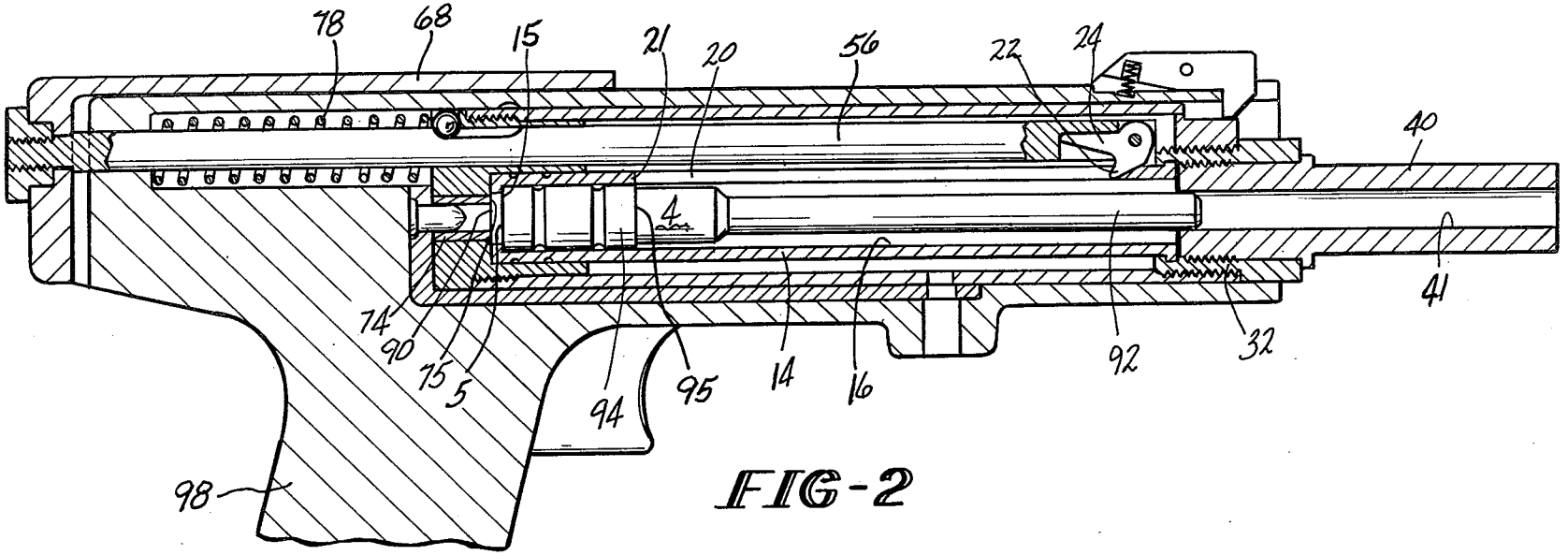
FIG. 2 is an axial sectional view similar to FIG. 1 but showing the tool in a ready to fire condition.

Referring now to FIG. 2, the tool 2 is shown in its push-down, ready to fire condition, wherein the power level of the tool is at its peak setting, wherein the rear face 5 of the piston 4 is in its closest position to the forward end surface 75 of the firing chamber boss 74. Thus the gas expansion chamber 90 provides a minimum volume into which combustion gases from the fired cartridge can expand before the piston is driven through the inner tube bore 16. The size of the expansion chamber 90 is determined by engagement of the rear face 5 of the piston 4 with the forward face 15 of an inwardly extending flange on the breechward end of the inner tube 14 which tube 14 is axially movable as will be hereinafter described more fully.

It will be noted in FIG. 2 that when the tool 2 is in its push-down condition, the cam ramp 26 will bear against the pawl tang 22 and cause the pawl 24 to pivot in a clockwise direction so that the tang 22 is moved out of the inner tube bore 16.

When the tool is fired, the piston 4 is propelled through the inner tube bore 16, with the forward stem portion 92 of the piston 4 passing into the bore 41 of the muzzle bushing 40. It will be understood that the fastener (not shown) to be driven is positioned in the muzzle bushing bore 41 prior to firing the tool. After the tool is fired, the tool is lifted away from the support surface and the spring 78 returns the internal sub-assembly to the position shown in FIG. 1, the only difference being that the piston 4 is in a driven position within the inner tube bore 16 with the piston head 94 being breechward of the pawl tang 22 so that the latter, having pivoted back into the inner tube bore 16, is in position to engage the front surface 95 of the piston head 94.

The piston 4 is returned to a firing position by grasping the cover 68 with one hand, while the other hand holds the pistol grip 98 of the tool, and pulling the cover 68 to the rear. The rod 56 is thus pulled to the rear along with the pawl 24. Engagement of the piston head surface 95 by the pawl tang 22 causes the piston 4 to be pulled from its fired position to its firing position. When the rear face of the piston 4 contacts the inner tube flange face 15, further rearward movement of the cover 68 is resisted by the spring 78, at which time the piston 4 will have been returned to its firing position. The cover 68, rod 56 and pawl 24 are then pushed forward and returned to their respective positions shown in FIG. 1. During the rearward movement of the cover 68, the barrel 10 is locked in the forward position by a ball 100 disposed in a hole 101 in the breech ring 12 and having a diameter greater than the thickness of the ring 12. When the cover 68 is in the forward position (see FIG. 3) the ball 100 rests in a slot 102 in the rod 56, allowing movement of the barrel 10. As the cover 68 is drawn back (see FIG. 1), bringing with it rod 56, the ball 100 rides up out of slot 102 and into recess 103 in the housing 8, locking the barrel 10 thereto, whereby the piston 4 may be returned to the firing position without compressing the spring 78.

Figure 3:
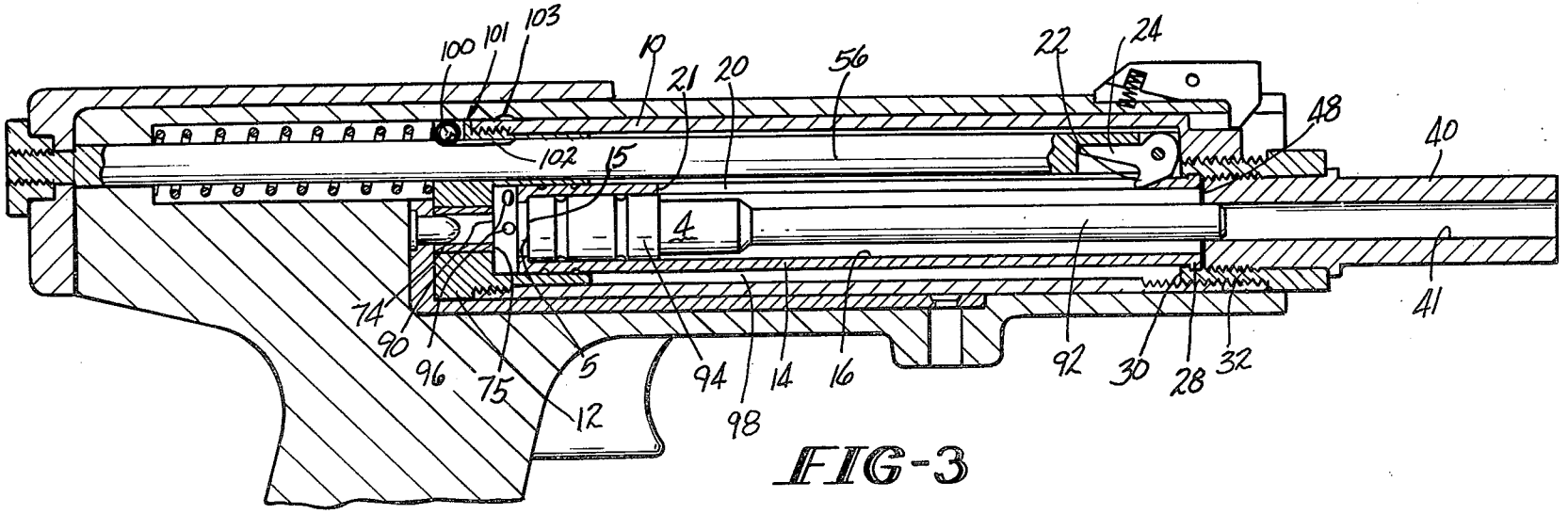
FIG. 3 is an axial sectional view similar to FIG. 1 but showing the power adjustment setting in a lower power level mode.

The power level of the tool is varied by varying the volume of the expansion chamber 90 as follows (see FIG. 3). By unscrewing the adjustment collar 32 forwardly out of the outer barrel 10, the collar flange 30 pulls the inner tube flange 28, and thus the inner tube 14 per se, forward away from the breech ring 12. In this way the rear end wall 21 of the slot 20 and the flange surface 15 are moved away from the breech ring 12. Thus the spacing between the forward end 75 of the firing chamber boss 74 and the rear surface 5 of the piston 4 will be increased. Since the volume of the expansion chamber 90 is increased, the combustion gases will have more room for expansion and more time to expend energy, before the piston 4 is driven, whereby the velocity of the piston 4 will be lower. It is noted that when the collar 32 is screwed back into the barrel 10, the inner tube 14 will be moved longitudinally rearwardly by reason of the muzzle bushing 40 moving against the muzzle end wall 48 of the inner tube 14, whereby the power level of the tool will be increased.

It has been found that the power level of the tool 2 can be adjusted in this manner between a high kinetic energy level, wherein the maximum piston kinetic energy is developed by the cartridge, to a medium power level, wherein an intermediate level of piston kinetic energy is developed, with a relatively short length of movement of the adjustment collar 32, whereby the overall length of the tool will not vary unduly.

To enable the tool to be fired at a low power level, there may be provided one or more gas vents 96 (see FIG. 3) which extend through the breech ring 12 and open into a cavity 98 which is preferably sealed from the ambient atmosphere and which is located between the inner tube 14 and the barrel 10. When the collar 32 is unscrewed sufficiently from the barrel 10, the inner tube 14 will be pulled forward sufficiently to uncover the gas vents 102 thereby providing a passage whereby combustion gases may be vented from the expansion chamber 90, further reducing the power with which the piston 4 is driven. By providing the vents 96, an adjustment can be made to low power without requiring excessive unscrewing of the adjustment collar and excessive lengthening of the overall tool length.

By properly positioning the vents, and sizing them, great design freedom is achieved along with versatile application, wherein high, medium, and low power requirements are met in one tool.

The tool 2 may be readily disassembled by unscrewing and removing the nut 70. The pawl 50 is then pivoted, in a counterclockwise direction as seen in the drawing, so as to remove the tooth 52 from the keying slot 54. The entire barrel sub-assembly, including the outer barrel 10, the breech ring 12, the inner tube 14, the adjustment collar 32 and the muzzle bushing 40, may now be slid from the housing 8.

Reassembly is accomplished by reinserting the sub-assembly into the housing 8, while the pawl 50 is retained in the unobstructing or retracted position. The pawl 50 is then released and nut 70 is screwed onto the protruding end 64 of rod 56.

It will be readily understood that the power adjustment mechanism of this invention provides for accurate power selection without the possibility of producing a greater than the preselected power. Change in power output is readily made by a simple screwing or unscrewing of the threaded adjustment collar. The use of the threaded adjustment collar permits a greater variety of power selections to be made within the limits of a preselected range of power values.

Since many changes and variations of the disclosed embodiment of the invention may be made without departing from the inventive concept, it is not intended to limit the invention otherwise than as required by the appended claims.

What is claimed is:

1. A power adjustment mechanism for use in a powder actuated fastener driving tool comprising:

(a) a housing;

(b) means forming a barrel connected to said housing, said barrel having a breech end and a muzzle end;

(c) means forming a firing chamber at the breech end of said barrel;

(d) a fastener driving piston reciprocally slidably disposed in said barrel;

(e) stop means nonrotatably reciprocally movably disposed in said barrel, muzzlewardly of said firing chamber, said stop means being operable to engage a breechward surface on said piston to stop return movement of said piston from a fired position to a firing position thereby establishing said firing position of said piston within said barrel; and (f) adjustment means operably connected to said stop means for moving said stop means axially of said barrel to selectively vary the spacing between said stop means and said firing chamber whereby a variable volume gas expansion chamber is provided in said barrel between said firing chamber and a breechward end of said piston to variably control power output of said tool.

2. A power adjustment mechanism for use in a powder actuated fastener driving tool comprising:

(a) a housing;

(b) means forming a barrel connected to said housing, said barrel having a bore with a breech end and a muzzle end;

(c) a firing chamber at the breech end of said barrel bore;

(d) a tube nonrotatably disposed in said barrel bore and mounted for axial reciprocal movement therein, said tube having a radial inwardly extending flange at its breechward end spaced muzzleward of said firing chamber;

(e) a fastener driving piston reciprocally slidably disposed in said tube, said piston being movable between a fired position and a firing position wherein a breechward surface of said piston engages said tube flange to establish the firing position of said piston; and (f) adjustment means threadedly connected to said barrel and operably connected to said tube so that rotation of said adjustment means on said barrel causes axial movement of said tube within said barrel bore to move said tube flange toward or away from said firing chamber whereby a variable volume gas expansion chamber is provided in said barrel bore between said firing chamber and a breechward end of said piston to variably control power output of said tool.

3. A power adjustment mechanism for use in a powder actuated fastener driving tool comprising:

(a) a housing;

(b) means for forming a barrel connected to said housing, said barrel having a bore with a breech end and a muzzle end;

(c) a firing chamber at the breech end of said barrel bore;

(d) a tube nonrotatably disposed in said barrel bore and mounted for axial reciprocal movement therein, means on said tube forming a stop at the breechward end of said tube, said stop being spaced muzzleward of said firing chamber;

(e) a fastener driving piston reciprocally slidably disposed in said tube, said piston being movable between a fired position and a firing position wherein said stop engages a breechward surface of said piston to establish the firing position of said piston; and (f) adjustment means operably connected to said tube for moving said tube and said stop axially of said barrel bore to selectively vary the spacing between said stop and said firing chamber whereby a variable volume gas expansion chamber is provided in said barrel between said firing chamber and a breechward end of said piston to variably control power output of said tool.

4. The mechanism of claim 3 further comprising means forming gas vents in said barrel spaced muzzleward of said firing chamber, said tube overlying said gas vents when said mechanism is in a high power mode, and said tube being movable muzzleward sufficiently to uncover said gas vents when said mechanism is in a low power mode.

* * * * *